US009704391B2

(12) United States Patent
Emura

(10) Patent No.: US 9,704,391 B2
(45) Date of Patent: Jul. 11, 2017

(54) TRAFFIC ACCIDENT DETECTION DEVICE AND METHOD OF DETECTING TRAFFIC ACCIDENT

(75) Inventor: Koichi Emura, Kanagawa (JP)

(73) Assignee: PANASONIC INTELLECTUAL PROPERTY MANAGEMENT CO., LTD., Osaka (JP)

( * ) Notice: Subject to any disclaimer, the term of this patent is extended or adjusted under 35 U.S.C. 154(b) by 883 days.

(21) Appl. No.: 13/880,633

(22) PCT Filed: Oct. 19, 2011

(86) PCT No.: PCT/JP2011/005854

§ 371 (c)(1),
(2), (4) Date: Apr. 19, 2013

(87) PCT Pub. No.: WO2012/056655

PCT Pub. Date: May 3, 2012

(65) Prior Publication Data

US 2013/0204515 A1 Aug. 8, 2013

(30) Foreign Application Priority Data

Oct. 28, 2010 (JP) ..... 2010-241982

(51) Int. Cl.
*G08G 1/00* (2006.01)
*G08G 1/01* (2006.01)
(Continued)

(52) U.S. Cl.
CPC ..... *G08G 1/00* (2013.01); *G07C 5/085* (2013.01); *G08G 1/0112* (2013.01);
(Continued)

(58) Field of Classification Search
CPC ..... G08G 1/00; G08G 1/0112; G08G 1/0133; G08G 1/0116; G08G 1/04; G07C 5/085
(Continued)

(56) References Cited

U.S. PATENT DOCUMENTS

2002/0111717 A1* 8/2002 Scherzinger et al. ..... 701/1
2009/0097504 A1 4/2009 Potenza et al.
(Continued)

FOREIGN PATENT DOCUMENTS

JP 08-068654 A 3/1996
JP 2000-207676 A 7/2000
(Continued)

OTHER PUBLICATIONS

International Search Report for PCT/JP2011/005854 dated Dec. 6, 2011.

*Primary Examiner* — Redhwan K Mawari
*Assistant Examiner* — Rodney P King
(74) *Attorney, Agent, or Firm* — Pearne & Gordon, LLP

(57) ABSTRACT

The present invention provides a traffic accident detection device of detecting traffic accident that estimates a precise speed variation for a vehicle, and detects dangerous events similar to traffic accidents. A time series estimation unit (202) chronologically estimates a speed from a detected speed of a vehicle that a sensor unit (102) has detected, and acquires a first estimated value; and a reverse time series estimation unit (204) reverse chronologically estimates a speed from the detected speed, and acquires a second estimated value. An integration estimation unit (206) estimates the speed and the speed shift of the vehicle by defining the first estimated value as an integrated estimated value until a time when the distance between the first estimated value and the second estimated value is at maximum, and defining the second estimated value as the integrated estimated value at the time the distance is at maximum and thereafter.

9 Claims, 13 Drawing Sheets

(51) Int. Cl.

| | |
|---|---|
| ***G08G 1/04*** | (2006.01) |
| ***G08G 1/052*** | (2006.01) |
| ***G07C 5/08*** | (2006.01) |

(52) U.S. Cl.
CPC ..... *G08G 1/0116* (2013.01); *G08G 1/0133* (2013.01); *G08G 1/04* (2013.01); *G08G 1/052* (2013.01)

(58) Field of Classification Search
USPC ..... 701/65, 70, 117–119
See application file for complete search history.

(56) References Cited

U.S. PATENT DOCUMENTS

| | | | | |
|---|---|---|---|---|
| 2010/0286907 | A1* | 11/2010 | Hilbrandie et al. | 701/201 |
| 2011/0184644 | A1* | 7/2011 | McBurney | G01C 21/12 701/532 |
| 2011/0254676 | A1* | 10/2011 | Marumoto | 340/441 |
| 2011/0267185 | A1* | 11/2011 | Zhang | G07C 5/008 340/437 |

FOREIGN PATENT DOCUMENTS

| | | | |
|---|---|---|---|
| JP | 2001-004382 | A | 1/2001 |
| JP | 2002-260149 | A | 9/2002 |
| JP | 2003-085685 | A | 3/2003 |
| JP | 2003-123185 | A | 4/2003 |
| JP | 2005-041467 | A | 2/2005 |
| JP | 2005-041472 | A | 2/2005 |

* cited by examiner

| SPEED[km/h] | THRESHOLD[G] |
|---|---|
| 0～20 | −0.39 |
| 20～40 | −0.53 |
| 40～60 | −0.65 |
| 60～80 | −0.73 |

FIG. 4

TRAFFIC ACCIDENT DETECTION DEVICE AND METHOD OF DETECTING TRAFFIC ACCIDENT

TECHNICAL FIELD

The present invention relates to a traffic accident detection apparatus and traffic accident detection method where a vehicle is observed with a sensor.

BACKGROUND ART

Accident prediction information and statistical/analytical information on accidents are useful in preventing vehicle accidents. Such information are provided to, for example, drivers, road administrators who are responsible for road safety design or for considering improvement measures, police who inspect traffic accidents and organize traffic safety campaigns, accident appraisers and insurers that conduct accident analyses, and so forth.

One known method for collecting such information is the drive recorder, for example. A drive recorder records images/video and sensor information of the few seconds before and after a sudden braking event detected by a vehicle-mounted sensor. The information recorded on the drive recorder is visualized, presented to the driver by a business operator that manages the vehicle, and thus utilized to raise awareness regarding traffic safety. The "Hiyari-Hatto Database" compiled by the Society of Automotive Engineers of Japan, which is a database comprised of image/videos and sensor information from drive recorders, enables causal analyses of accidents based on large volumes of hiyari-hatto data, and is used by auto manufacturers in developing traffic safety assistance apparatuses, and/or the like. The term "hiyari-hatto" refers to a state where, although a collision did not take place, one was close to happening.

Although such drive recorders are gradually becoming common place on business vehicles, e.g., taxis, buses, etc., it is unrealistic to expect drive recorders to be mounted on all vehicles on public roads, including ordinary vehicles. On the other hand, since 60% of traffic accidents take place at intersections, it is desired that accidents and hiyari-hattos be detected based on changes in vehicle speed observed by roadside sensors installed at intersections.

To that end, Patent Literature 1, for example, discloses a traffic accident detection apparatus that uses a vehicle detection sensor installed at an intersection. FIG. 1 is a block diagram showing a configuration of traffic accident detection apparatus 10 disclosed in Patent Literature 1. As shown in FIG. 1, traffic accident detection apparatus 10 includes imaging device 11, vehicle detection sensor 12, data recording section 13, data analysis section 14, and recording control section 15.

Imaging device 11 constantly captures the traffic conditions in its observation area. The image data thus captured is temporarily recorded (cached) in data recording section 13. Vehicle detection sensor 12 detects all vehicles within the observation area, monitoring, as well as outputting to data analysis section 14, changes in the position and speed of each vehicle over time.

Data analysis section 14 analyses the data outputted from vehicle detection sensor 12. By way of example, data analysis section 14 determines if an accident or a dangerous situation has occurred by detecting sudden acceleration changes of a vehicle, abnormal proximity of positional data between a plurality of vehicles, and/or the like, and notifies recording control section 15 of the determination result.

If the determination result received from data analysis section 14 indicates that an accident or a dangerous situation has occurred, recording control section 15 has data recording section 13 record the imaged data of a given duration preceding and following that occurrence.

As a filter for correcting errors contained in observation values, the Kalman filter is widely known. As an application example of the Kalman filter, Patent Literature 2, for example, discloses a current position detection apparatus for vehicles which detects the current position of a vehicle based on the vehicle's orientation and traveled distance.

FIG. 2 is a block diagram showing a configuration of current vehicle position detection apparatus 20 disclosed in Patent Literature 2. As shown in FIG. 2, current vehicle position detection apparatus 20 includes vehicle speed sensor 21, gyro 22, GPS 23, relative path computation section 24, absolute position computation section 25, and Kalman filter 26.

By having computations (dead-reckoning computations) carried out at relative path computation section 24 and absolute position computation section 25 based on signals from vehicle speed sensor 21 and gyro 22, vehicle speed, absolute orientation, relative path, and absolute position are outputted. Further, outputs of position, orientation, and vehicle speed are obtained from GPS 23. Based on the vehicle speed, absolute orientation, and absolute position information obtained through dead-reckoning, as well as the vehicle speed, orientation, and position information from GPS 23, Kalman filter 26 performs vehicle speed sensor distance coefficient correction, gyro offset correction, absolute orientation correction, and absolute position correction.

CITATION LIST

Patent Literature

PTL 1
Japanese Patent Application Laid-Open No. 2000-207676
PTL 2
Japanese Patent Application Laid-Open No. HEI 8-68654

SUMMARY OF INVENTION

Technical Problem

However, due to the fact that vehicles are not uniformly oriented at intersections, for example, the emitted wave from the sensor for detecting vehicles and pedestrians is reflected by unexpected parts of other vehicles and one's own vehicle, thereby causing noise. With the technique disclosed in Patent Literature 1 mentioned above, even if one were to employ the technique disclosed in Patent Literature 2, there would still be unpredictable errors in the observation values by the vehicle detection sensor, as a result of which it would be impossible to correctly determine speed changes. In other words, it would be difficult to accurately determine when sudden braking occurred.

An object of the present invention is to provide a traffic accident detection apparatus and traffic accident detection method that estimate an accurate speed change of a vehicle, and detect risk events comparable to traffic accidents.

Solution to Problem

A traffic accident detection apparatus of the present invention may be configured to include: a sensor section that observes a vehicle and obtains speed observation values of the vehicle; a time-series/reverse-time-series combined estimation section that obtains the speed observation values from the sensor section, computes time-series speed estimate values and reverse-time-series speed estimate values, and computes speed estimate values based on the time-series speed estimate values and the reverse-time-series speed estimate values, the time-series speed estimate values being estimated in a time-series fashion based on the speed observation values, the reverse-time-series speed estimate values being estimated in a reverse-time-series fashion based on the speed observation values; an acceleration computation section that computes acceleration values in a time-series fashion based on an amount of change in the speed estimate values per unit time; and a sudden braking determination section that compares the acceleration values and a predefined determination threshold in a time-series fashion, and determines a time at which the acceleration values are less than the determination threshold to be a sudden braking time of the vehicle.

A traffic accident detection method of the present invention may be so arranged that: a sensor section observes a vehicle and obtains speed observation values of the vehicle; a time-series/reverse-time-series combined estimation section obtains the speed observation values from the sensor section, computes time-series speed estimate values and reverse-time-series speed estimate values, and computes speed estimate values based on the time-series speed estimate values and the reverse-time-series speed estimate values, the time-series speed estimate values being estimated in a time-series fashion based on the speed observation values, the reverse-time-series speed estimate values being estimated in a reverse-time-series fashion based on the speed observation values; an acceleration computation section computes acceleration values in a time-series fashion based on an amount of change in the speed estimate values per unit time; and a sudden braking determination section compares the acceleration values and a pre-defined determination threshold in a time-series fashion, and determines a time at which the acceleration values are less than the determination threshold to be a sudden braking time of the vehicle.

Advantageous Effects of Invention

With the present invention, it is possible to provide a traffic accident detection apparatus and traffic accident detection method that estimate an accurate speed change of a vehicle, and detect risk events comparable to traffic accidents.

BRIEF DESCRIPTION OF DRAWINGS

FIG. 4 is a diagram showing a table held by a sudden braking determination section;

DESCRIPTION OF EMBODIMENTS

Embodiments of the present invention are described in detail below with reference to the drawings.

Embodiment 1

Figure 1:
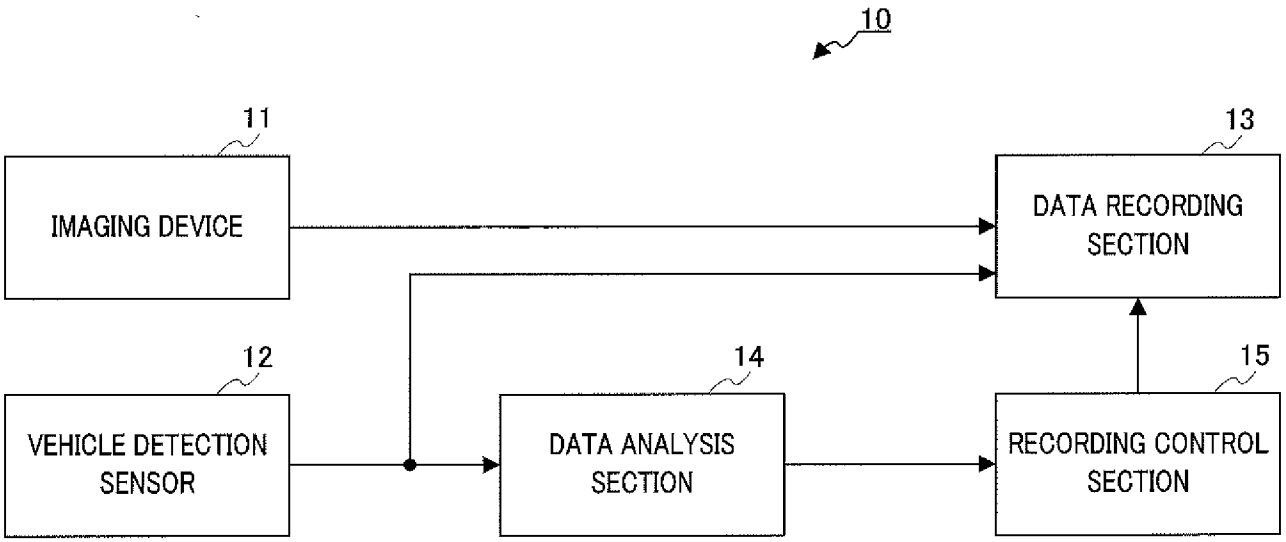
FIG. 1 is a block diagram showing a configuration of a traffic accident detection apparatus disclosed in Patent Literature 1.
Figure 2:
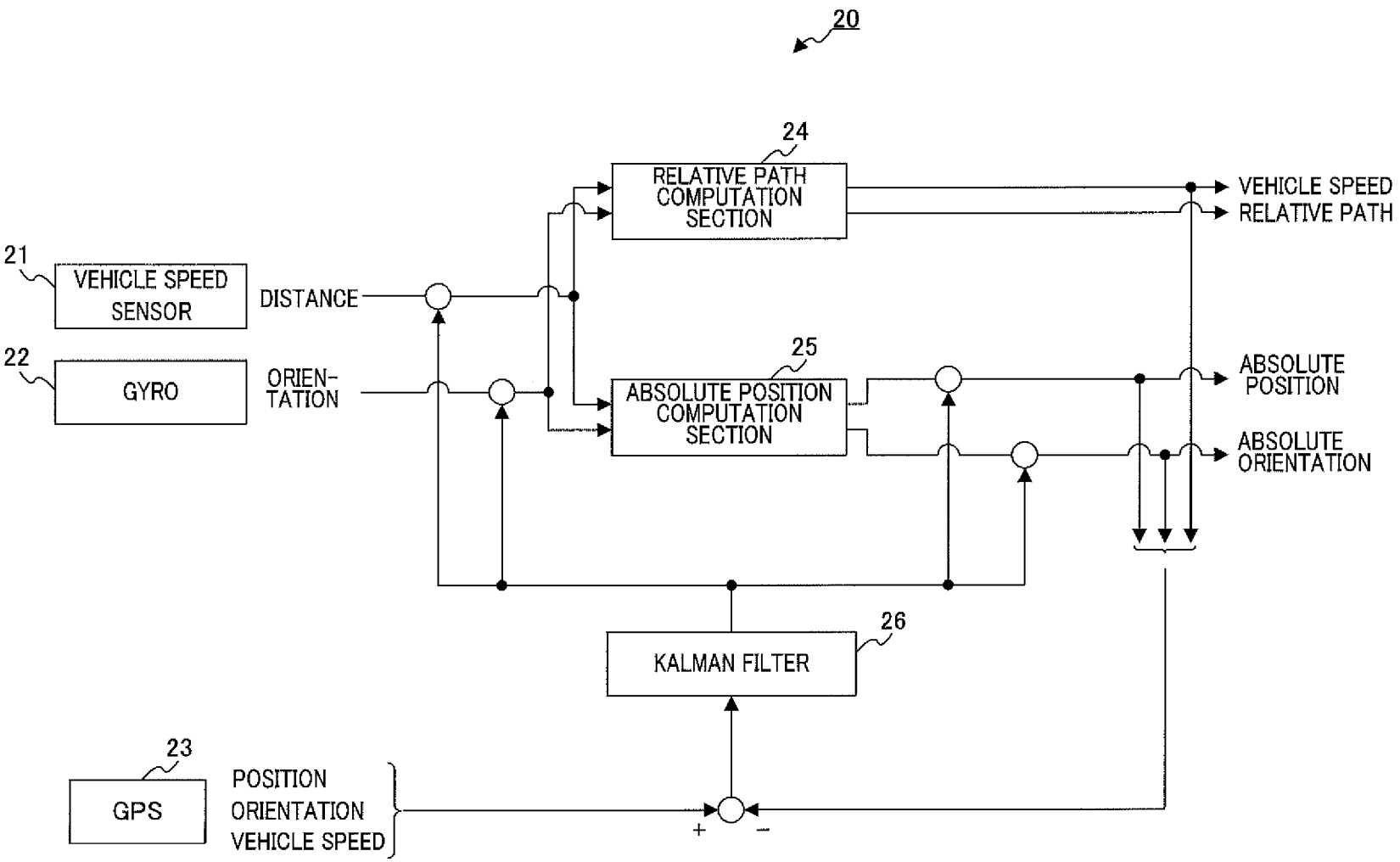
FIG. 2 is a block diagram showing a configuration of a current vehicle position detection apparatus disclosed in Patent Literature 2.
Figure 3:
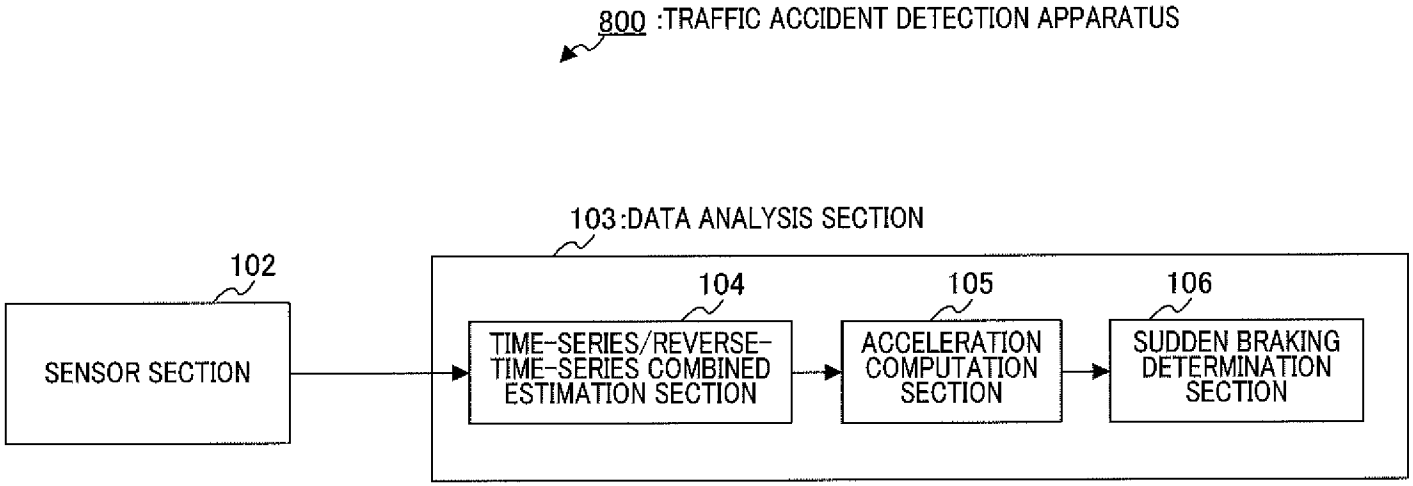
FIG. 3 is a block diagram showing key features of a traffic accident detection apparatus according to Embodiment 1 of the present invention.

FIG. 3 is a block diagram showing key features of traffic accident detection apparatus 800 according to Embodiment 1 of the present invention. Traffic accident detection apparatus 800 includes sensor section 102 and data analysis section 103. Data analysis section 103 includes time-series/reverse-time-series combined estimation section 104, acceleration computation section 105, and sudden braking determination section 106. A configuration of traffic accident detection apparatus 800 is described below with reference to FIG. 3.

Sensor section 102 detects all vehicles present within an observation area, and obtains and outputs time-series speed observation values for each vehicle.

Time-series/reverse-time-series combined estimation section 104 included in data analysis section 103 obtains time-series speed observation values from sensor section 102, and computes time-series speed estimate values and reverse-time-series speed estimate values based on the speed observation values. Since speed observation values include noise caused by surrounding vehicles, the vehicle speed of the vehicle of interest must be estimated based on speed observation values. Noise is caused by scattered reflection in the case of radar-based sensing, or by occlusion in the case of camera-based sensing.

Time-series speed estimate values are estimated using the Kalman filter, and/or the like, and by reading speed observation values in a time series fashion. Specifically, time-series speed estimate values are estimated based on speed observation values read in a time-series fashion, their observed times, and the Kalman gain value derived from the Kalman filter. Reverse-time-series speed estimate values are estimated using the Kalman filter, and/or the like, and by reading speed observation values in a reverse-time-series fashion. Specifically, reverse-time-series speed estimate values are estimated based on speed observation values read in a reverse-time-series fashion, their observed times, and the Kalman gain value.

Time-series/reverse-time-series combined estimation section 104 computes speed estimate values based on the time-series speed estimate values and the reverse-time-series speed estimate values. Specifically, speed estimate values are computed by determining the time of observation at which the difference between the time-series speed estimate values and the reverse-time-series speed estimate values becomes greatest (hereinafter referred to as combination time in some cases), and then combining the time-series speed estimate values preceding the combination time and the reverse-time-series speed estimate values following the combination time.

Acceleration computation section 105 obtains, in a time series fashion, the speed estimate values computed at time-series/reverse-time-series combined estimation section 104, and, based on the amount of change in the speed estimate values per unit time, computes acceleration values in a time-series fashion.

Sudden braking determination section 106 obtains, in a time-series fashion, the acceleration values computed at acceleration computation section 105, and makes a comparative determination between the time-series acceleration values and a pre-defined determination threshold. An observation time at which the acceleration value is less than the determination threshold is determined as being a sudden braking time of the vehicle. Also, if the acceleration values are greater than the determination threshold at all times, the sudden braking determination section determines that no sudden braking took place.

Thus, traffic accident detection apparatus 800 according to the present embodiment estimates vehicle speed in a time-series fashion and a reverse-time-series fashion based on speed observation values, and detects the time at which the vehicle made a sudden brake through a comparative determination between acceleration values of speed estimate values, which are computed based on time-series and reverse-time-series speed estimate values, and a determination threshold. Thus, traffic accident detection apparatus 800 is able to accurately detect correct speed changes (the time at which sudden braking occurred) even when unpredictable errors occur in the values observed by the vehicle detection sensor.

In the description above, sudden braking determination section 106 uses a pre-defined determination threshold to determine if sudden braking has occurred. However, the determination threshold may also be made variable based on speed estimate values. Specifically, as in the table shown in FIG. 4, a threshold may be defined in advance for each unit per-hour-speed, and the determination threshold may be defined for each observation time based on the thresholds of the respective unit per-hour-speeds and on the speed estimate values. By so doing, it becomes possible to carry out accurate sudden braking time detection that takes into account a property where acceleration is higher when the vehicle speed is fast, and lower when the vehicle speed is slow. As such, the determination threshold varies in accordance with the corresponding speed. Sudden braking determination section 106 obtains speed estimate values in a time-series fashion, finds the determination threshold for each observation time based on the obtained speed estimate values, and determines if sudden braking has occurred based on the defined determination threshold and on acceleration values.

Embodiment 2

Figure 5:
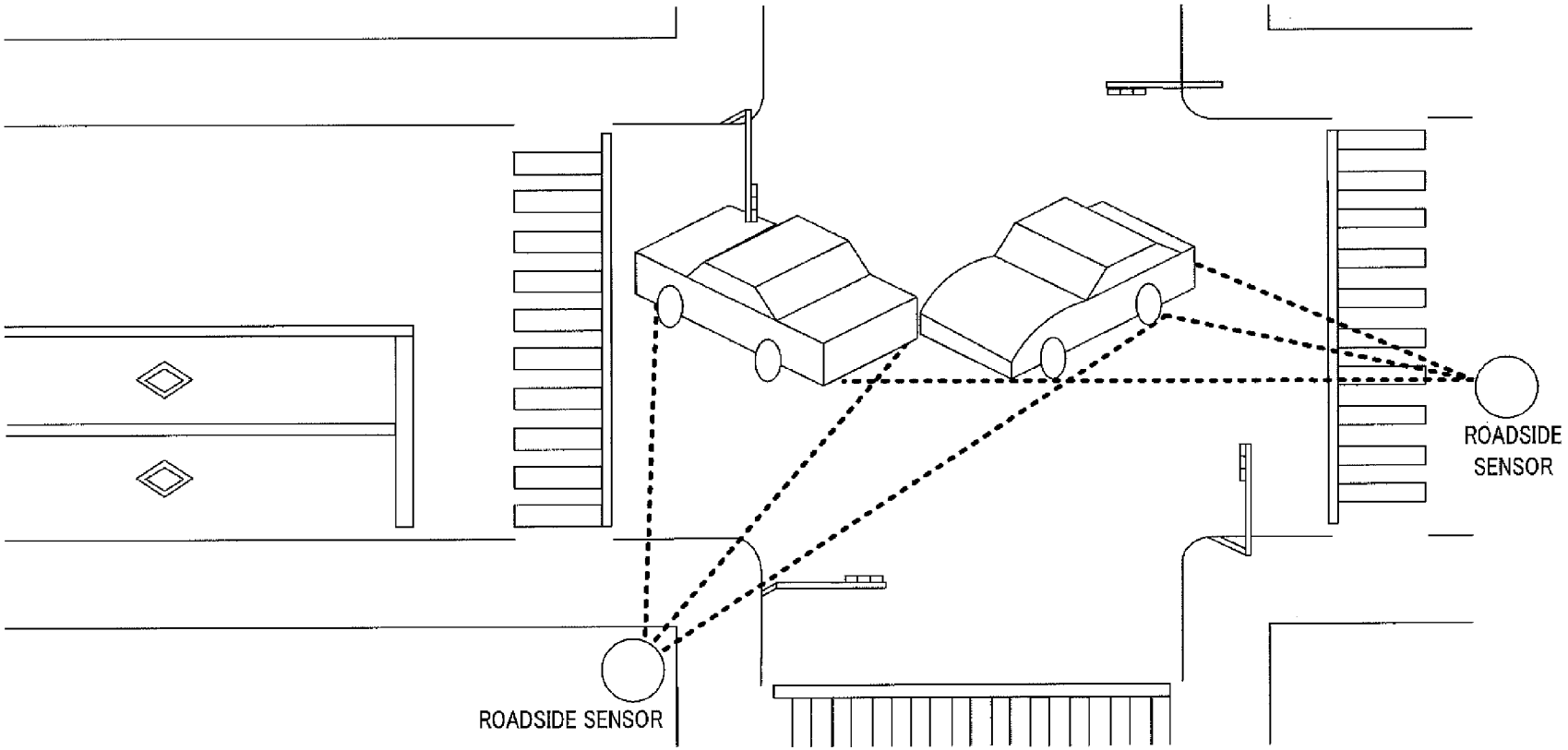
FIG. 5 is a schematic view showing an installation example of a traffic accident detection apparatus according to Embodiment 2 of the present invention.

FIG. 5 is a schematic view showing an installation example of a traffic accident detection apparatus according to Embodiment 2 of the present invention. As shown in FIG. 5, roadside sensors of the traffic accident detection apparatus are installed on utility poles, road signs, and/or the like near an intersection. The roadside sensors observe the speed and/or the like of a vehicle entering the intersection. Although not shown in the drawing, roadside sensors may also be installed on traffic lights, sign boards, building walls, and/or the like, and need only be fixed at heights ranging from 2 m to 7 m above ground, for example. Sensors need not be installed on road sides, and may instead be vehicle-mounted sensors mounted on various vehicles. In the description below, it is assumed that the term "sensor" refers to a roadside sensor or a vehicle-mounted sensor.

Figure 6:
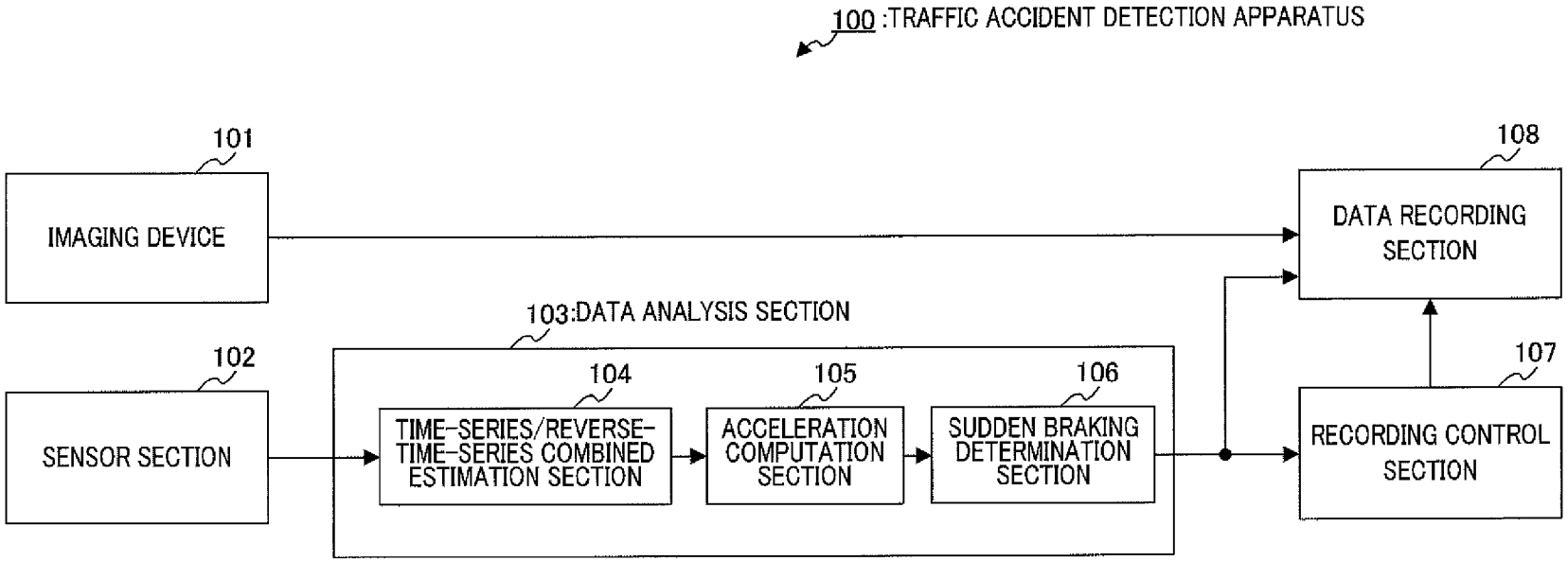
FIG. 6 is a block diagram showing a configuration of a traffic accident detection apparatus according to Embodiment 2 of the present invention.

FIG. 6 is a block diagram showing a configuration of traffic accident detection apparatus 100 according to Embodiment 2 of the present invention. Traffic accident detection apparatus 100 includes imaging device 101, sensor section 102, data analysis section 103, recording control section 107, and data recording section 108. Key features of traffic accident detection apparatus 100 include sensor section 102 and data analysis section 103. Data analysis section 103 includes time-series/reverse-time-series combined estimation section 104, acceleration computation section 105, and sudden braking determination section 106.

A configuration of traffic accident detection apparatus 100 is described below with reference to FIG. 6. Imaging device 101 captures motion picture, and temporarily records (caches) the captured motion picture in data recording section 108.

Sensor section 102 detects all vehicles present within an observation area, obtains speed observation values of each vehicle in a time-series fashion, and outputs them to time-series/reverse-time-series combined estimation section 104 of data analysis section 103.

Data analysis section 103 includes time-series/reverse-time-series combined estimation section 104, acceleration computation section 105, and sudden braking determination section 106.

Time-series/reverse-time-series combined estimation section 104 obtains, in a time-series fashion, the speed observation values outputted from sensor section 102, and, based on the time-series speed observation values, estimates the speed of the vehicle in a time-series fashion and a reverse-time-series fashion. Based on the vehicle speeds estimated in a time-series fashion and the vehicle speeds estimated in a reverse-time-series fashion. time-series/reverse-time-series combined estimation section 104 computes speed estimate values and outputs them to acceleration computation section 105.

Specifically, time-series/reverse-time-series combined estimation section 104 computes time-series speed estimate values and reverse-time-series speed estimate values based on time-series speed observation values. Time-series/reverse-time-series combined estimation section 104 computes a combination time, which is the observation time at which the difference between the time-series speed estimate values and the reverse-time-series speed estimate values becomes greatest, and computes speed estimate values by combining the time-series speed estimate values preceding the combination time with the reverse-time-series speed estimate values following the combination time.

Acceleration computation section 105 obtains, in a time series fashion, the speed estimate values outputted from time-series/reverse-time-series combined estimation section 104, and, based on time-series changes in the obtained speed estimate values, computes acceleration values of the vehicle. The computed acceleration values of the vehicle are outputted to sudden braking determination section 106. The speed of the vehicle is hereinafter simply referred to as "speed value," and the acceleration of the vehicle as "acceleration value."

Sudden braking determination section 106 makes a comparative determination between the acceleration values obtained from acceleration computation section 105 and a pre-defined determination threshold. If the acceleration value is less than the determination threshold, it is determined that the vehicle has made a sudden brake.

In cases where traffic accident detection apparatus 100 is operated as a system, sudden braking determination section 106 outputs the determination result and the sudden braking time to recording control section 107 and data recording section 108. The sudden braking of a vehicle is hereinafter referred to simply as "sudden braking."

If the analysis result outputted from data analysis section 103 indicates sudden braking, recording control section 107 obtains the time at which the sudden braking took place (sudden braking time), and computes a record start time and a record end time based on the obtained sudden braking time. Recording control section 107 sets the computed record start time and record end time in data recording section 108.

Data recording section 108 records, from the cache onto a recording medium, the image data of from the record start time to the record end time set by recording control section 107 and the analysis data of data analysis section 103. Once recording on the recording medium is completed, data recording section 108 deletes the image data and analytical data that were temporarily recorded before a given point in time that goes back a predetermined period of time from the current time.

Imaging device 101, recording control section 107, and data recording section 108 are not key features of traffic accident detection apparatus 100. Even if they are omitted, the present invention still produces an advantageous effect where the time at which sudden braking took place is determined accurately. By providing imaging device 101, recording control section 107, and data recording section 108, a system that detects traffic accidents is constructed.

Figure 7:
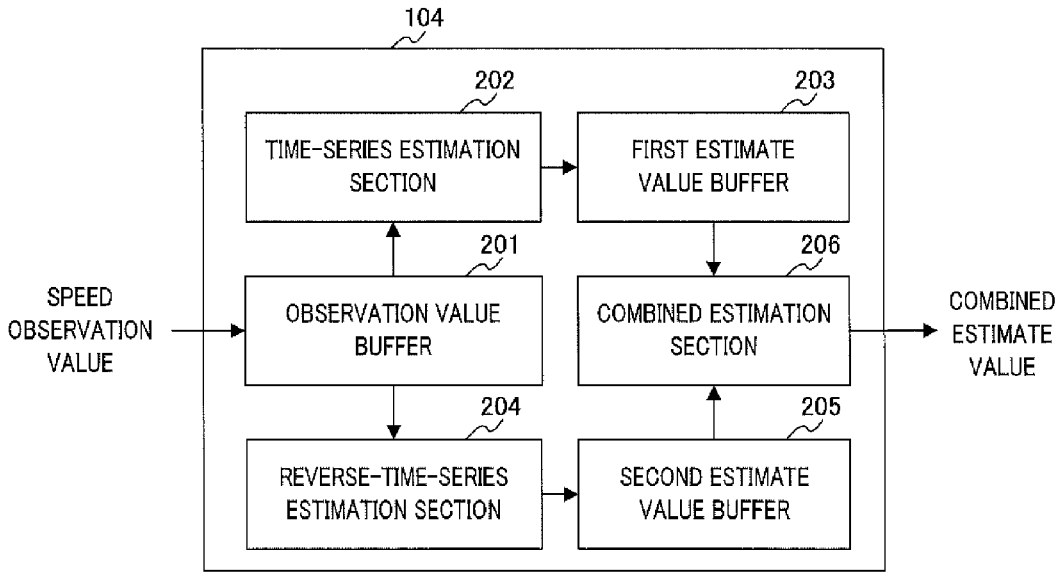
FIG. 7 is a block diagram showing an internal configuration of the time-series/reverse-time-series combined estimation section shown in FIG. 6.

FIG. 7 is a block diagram showing an internal configuration of time-series/reverse-time-series combined estimation section 104 shown in FIG. 6. An internal configuration of time-series/reverse-time-series combined estimation section 104 is described below with reference to FIG. 7.

Observation value buffer 201 stores speed observation values outputted from sensor section 102. The stored speed observation values are read out by time-series estimation section 202 and reverse-time-series estimation section 204.

Time-series estimation section 202 reads out, in a time-series fashion, the speed observation values stored in observation value buffer 201, and estimates speed in a time-series fashion. The estimated time-series speed estimate values are outputted to first estimate value buffer 203 as first estimate values.

Reverse-time-series estimation section 204 reads out, in a reverse-time-series fashion, the speed observation values stored in observation value buffer 201, and estimates speed in a reverse-time-series fashion. The estimated reverse-time-series speed estimate values are outputted to second estimate value buffer 205 as second estimate values.

Figure 8:
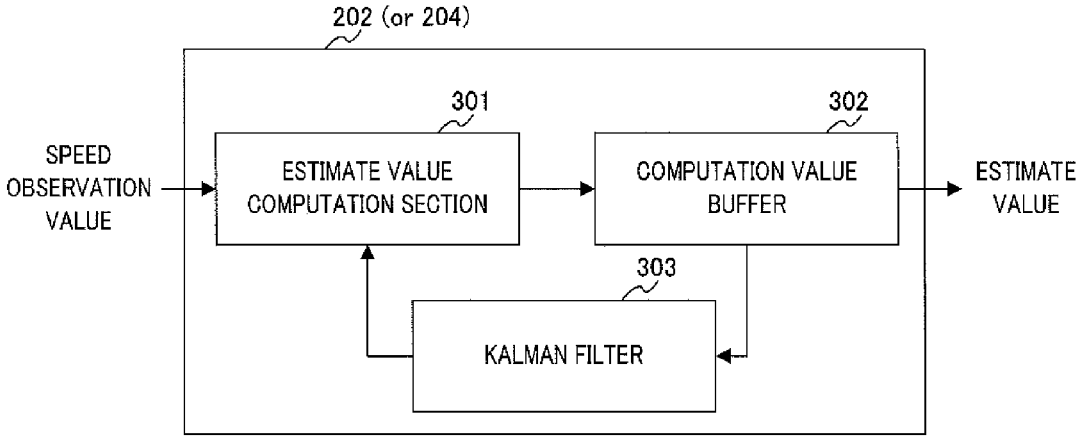
FIG. 8 is a block diagram showing an internal configuration of the time-series estimation section or the reverse-time-series estimation section shown in FIG. 7.

FIG. 8 shows an internal configuration of time-series estimation section 202 and reverse-time-series estimation section 204. With respect to time-series estimation section 202, based on speed observation values read out in a time-series fashion from observation value buffer 201 along with their observation times, and on the Kalman gain value derived from Kalman filter 303, estimate value computation section 301 computes time-series speed estimate values (i.e., first estimate values). Computation value buffer 302 holds the speed estimate value from one time unit ago (e.g., 100 milliseconds ago), while also outputting it to first estimate value buffer 203. Kalman filter 303 forms an error distribution based on speed estimate values from one time unit ago, derives the Kalman gain value, and feeds it back to estimate value computation section 301.

With respect to reverse-time-series estimation section 204, estimate value computation section 301 reads out speed observation values from observation value buffer 201 in a reverse-time-series fashion starting with the speed observation value observed most recently. Based on speed observation values read out in a reverse-time-series fashion along with their observation times, and on the Kalman gain value derived from Kalman filter 303, estimate value computation section 301 computes reverse-time-series speed estimate values (i.e., second estimate values). Computation value buffer 302 holds the speed estimate value from one time unit later (e.g., 100 milliseconds later), while also outputting it to second estimate value buffer 205. Kalman filter 303 forms an error distribution based on speed estimate values from one time unit later, derives the Kalman gain value, and feeds it back to estimate value computation section 301.

First estimate value buffer 203 stores the first estimate values outputted by time-series estimation section 202. The stored first estimate values are read out by combined estimation section 206. Second estimate value buffer 205 stores the second estimate values outputted by reverse-time-series estimation section 204. The stored second estimate values are read out by combined estimation section 206.

Combined estimation section 206 outputs, to acceleration computation section 105 and sudden braking determination section 106 as combined estimate values, the first estimate values up until the time at which the difference between each first estimate value (time-series speed estimate value) read out from first estimate value buffer 203 and each second estimate value (reverse-time-series estimate value) read out from second estimate value buffer 205 at the same time becomes greatest (i.e., before the combination time), and it outputs the second estimate values after the time at which the difference becomes greatest (i.e., after the combination time).

In other words, combined estimation section 206 computes speed estimate values by determining the observation time at which the difference between the first estimate values (the time-series speed estimate values) and the second estimate values (the reverse-time-series speed estimate values) becomes greatest (i.e., the combination time), and by combining the first estimate values preceding the combination time and the second speed estimate values following the combination time.

Figure 9:
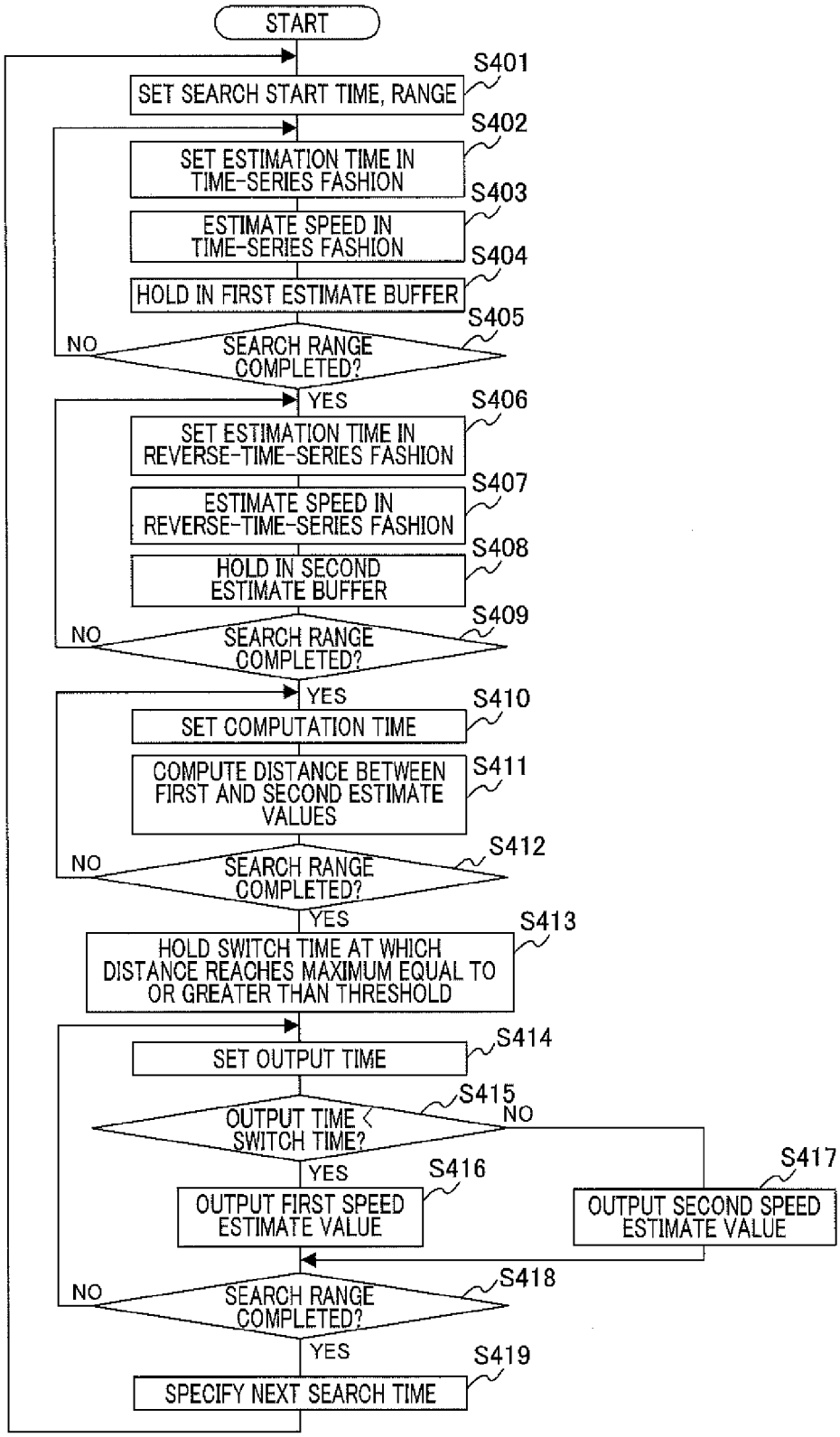
FIG. 9 is a flowchart showing a processing procedure for the time-series/reverse-time-series combined estimation section shown in FIG. 7.

FIG. 9 shows a flowchart for a processing procedure at time-series/reverse-time-series combined estimation section 104. A process flow of time-series/reverse-time-series combined estimation section 104 is described below with reference to FIG. 9.

In step S401, time-series/reverse-time-series combined estimation section 104 sets a search start time and a search range.

By way of example, if an observation value is inputted every 100 milliseconds, time-series/reverse-time-series combined estimation section 104 is configured to perform processing by shifting a three-second search range by 100 milliseconds at a time. Specifically, the search start time is successively shifted from 0 seconds to 3000 milliseconds 100 milliseconds at a time. First, in step S401, in order to determine the "time-series speed estimate values" and the "reverse-time-series speed estimate values" based on speed observation values from 0 seconds to 3000 milliseconds, the search start time is set to 0 milliseconds, and the search range is set to be from 0 milliseconds to 3000 milliseconds (first run). Next, in step S401, in order to determine the "time-series speed estimate values" and the "reverse-time-series speed estimate values" based on speed observation values from 100 milliseconds to 3100 milliseconds, the search start time is set to 100 milliseconds, and the search range is set to be from 100 milliseconds to 3100 milliseconds (second run). Search ranges are subsequently set in a similar fashion.

Sufficient memory to buffer three-seconds' worth of speed observation values sampled at 100 milliseconds is allocated to observation value buffer 201, first estimate value buffer 203, and second estimate value buffer 205.

With respect to the search range, time-series/reverse-time-series combined estimation section 104 carries out time-series estimation for each estimation time by successively setting estimation times from the earliest time to the latest time, and carries out reverse-time-series estimation for each estimation time by setting estimation times in reverse from the latest time to the earliest time.

In step S402, time-series estimation section 202 sets an estimation time within the search range. It estimates speed in a time-series fashion in step S403. In step S404, it temporarily stores a speed estimate value (a first estimate value) in first estimate value buffer 203. In step S405, time-series estimation section 202 determines whether or not the search range has been completed, and if not, repeats step S402 through step S404 until it is completed, proceeding to step S406 once the search range has been completed. In step S402 of the second and subsequent runs, the estimation time is set to an observation time that follows by 100 milliseconds. By way of example, in a case where processing is carried out with observation times of 0 to 3000 milliseconds as the search range, time-series estimation section 202 estimates speed by reading out observation values from observation value buffer 201 while successively shifting the estimation time, as in from 0 milliseconds to 100 milliseconds, and then to 200 milliseconds, and so forth.

Next, in step S406, reverse-time-series estimation section 204 sets an estimation time within the search range. It estimates speed in a reverse-time-series fashion in step S407. In step S408, it temporarily stores a speed estimate value (a second estimate value) in second estimate value buffer 205. In step S409, reverse-time-series estimation section 204 determines whether or not the search range has been completed, and if not, repeats step S406 through step S408 until it is completed, proceeding to step S410 once the search range has been completed. In step S406 of the second and subsequent runs, the estimation time is set to an observation time that precedes by 100 milliseconds. By way of example, in a case where processing is carried out with observation times of 0 to 3000 milliseconds as the search range, reverse-time-series estimation section 204 estimates speed by reading out observation values from observation value buffer 201 while successively going through the estimation times backwards, as in from 2900 milliseconds to 2800 milliseconds, and then to 2700 milliseconds, and so forth.

Next, in step S410, with respect to the search range, combined estimation section 206 sets computation times from the earliest time to the latest time. In step S411, it reads out a first estimate value and a second estimate value corresponding to the same computation time from first estimate value buffer 203 and second estimate value buffer 205, respectively, and computes the distance between the first estimate value and the second estimate value. In step S412, combined estimation section 206 determines whether or not the search range has been completed, and if not, repeats step S410 and step S411 until it is completed, proceeding to step S413 once the search range has been completed.

Next, in step S413, combined estimation section 206 holds, as a switch time (a combination time), the time at which the difference computed in step S411 becomes greatest. In step S414, combined estimation section 206 sets an output time within the search range, and determines, in step S415, whether or not the output time precedes the switch time. If the output time precedes the switch time (i.e., YES), the first estimate value is outputted in step S416, whereas if the output time follows the switch time (i.e., NO), it outputs the second estimate value in step S417. In step S418, combined estimation section 206 determines whether or not the search range has been completed, and if not, repeats step S414 through step S417 until it is completed, proceeding to step S419 once the search range has been completed.

Finally, in step S419, time-series/reverse-time-series combined estimation section 104 specifies the next search start time and returns to step S401.

The description above assumes that, in cases where an observation value is inputted every 100 milliseconds, time-series/reverse-time-series combined estimation section 104 is configured to perform processing by shifting a three-second search range by 100 milliseconds at a time. However, this is by no means limiting.

Figure 10:
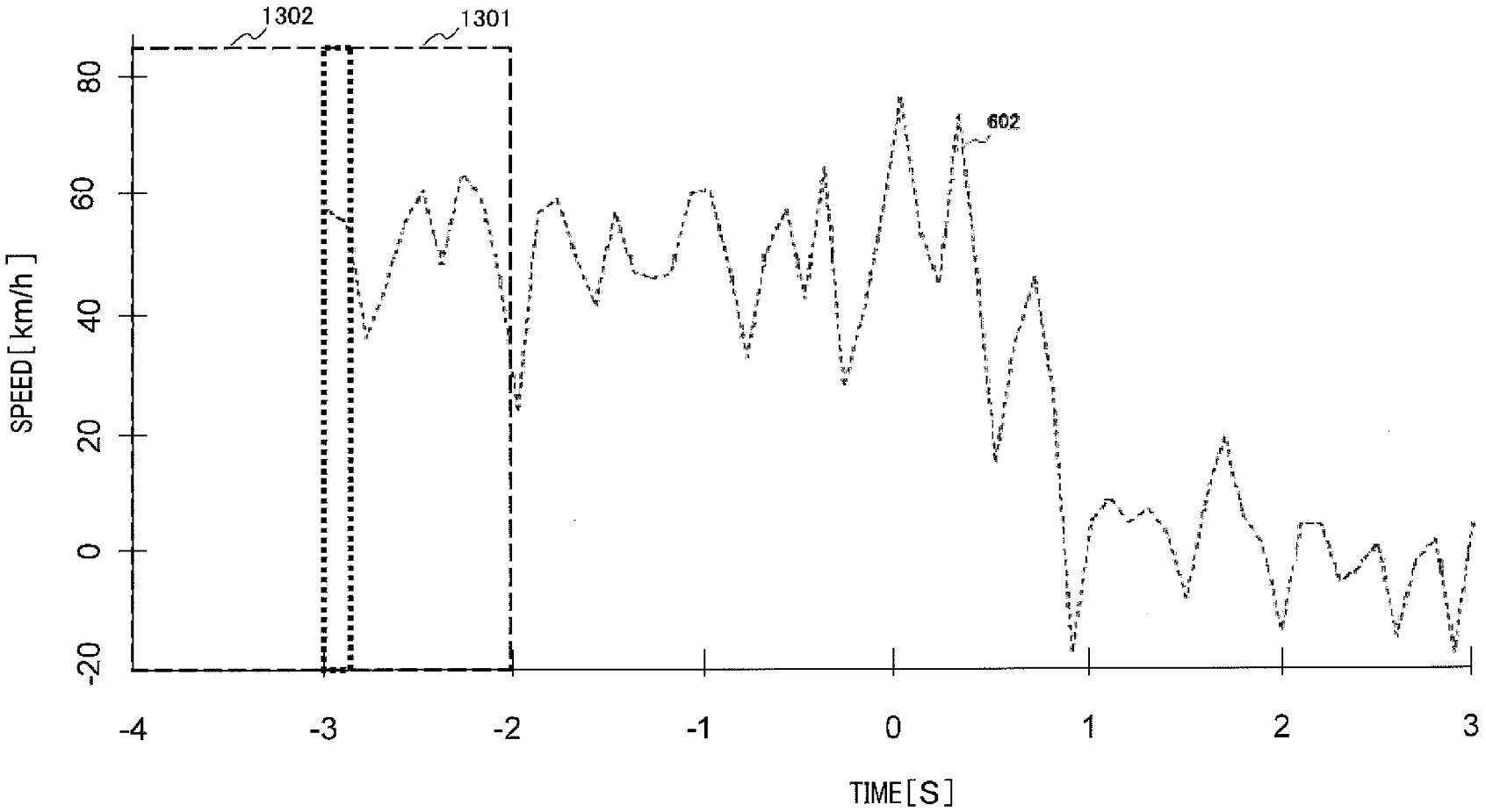
FIG. 10 is a diagram illustrating a search range.

By way of example, in a case where an observation value is inputted every 100 milliseconds, time-series/reverse-time-series combined estimation section 104 may also be configured to perform processing by shifting a two-second search range by 100 milliseconds at a time. FIG. 10 is a diagram illustrating a search range. Specifically, with respect to FIG. 10, the search start time is successively shifted by 100 milliseconds at a time from −3 seconds to 2.9 seconds. First, in order to determine the "time-series speed estimate values" and the "reverse-time-series speed estimate values" during the period between −3 seconds and −2.9 seconds based on speed observation values 1301 during the period between the search start time of −3 seconds and −2.9 seconds, which is 100 milliseconds therefrom, search range 1302 is set to −4 seconds to −2 seconds. The reason a wider search range than the period for computing speed estimate values is set is because errors occur at both ends of a search range. Next, in order to determine the "time-series speed estimate values" and the "reverse-time-series speed estimate values" during the period between −2.9 seconds and −2.8 seconds based on speed observation values during the period between the search start time of −2.9 seconds and −2.8 seconds, which is 100 milliseconds therefrom, the search range is set to −3.9 seconds to −1.9 seconds. Search ranges are subsequently set in a similar fashion.

In other words, the range of speed observation values used to compute time-series speed estimate values and reverse-time-series speed estimate values at the time-series/reverse-time-series combined estimation section is broader than the range of time-series speed estimate values and reverse-time-series speed estimate values of the computed results.

Figure 11:
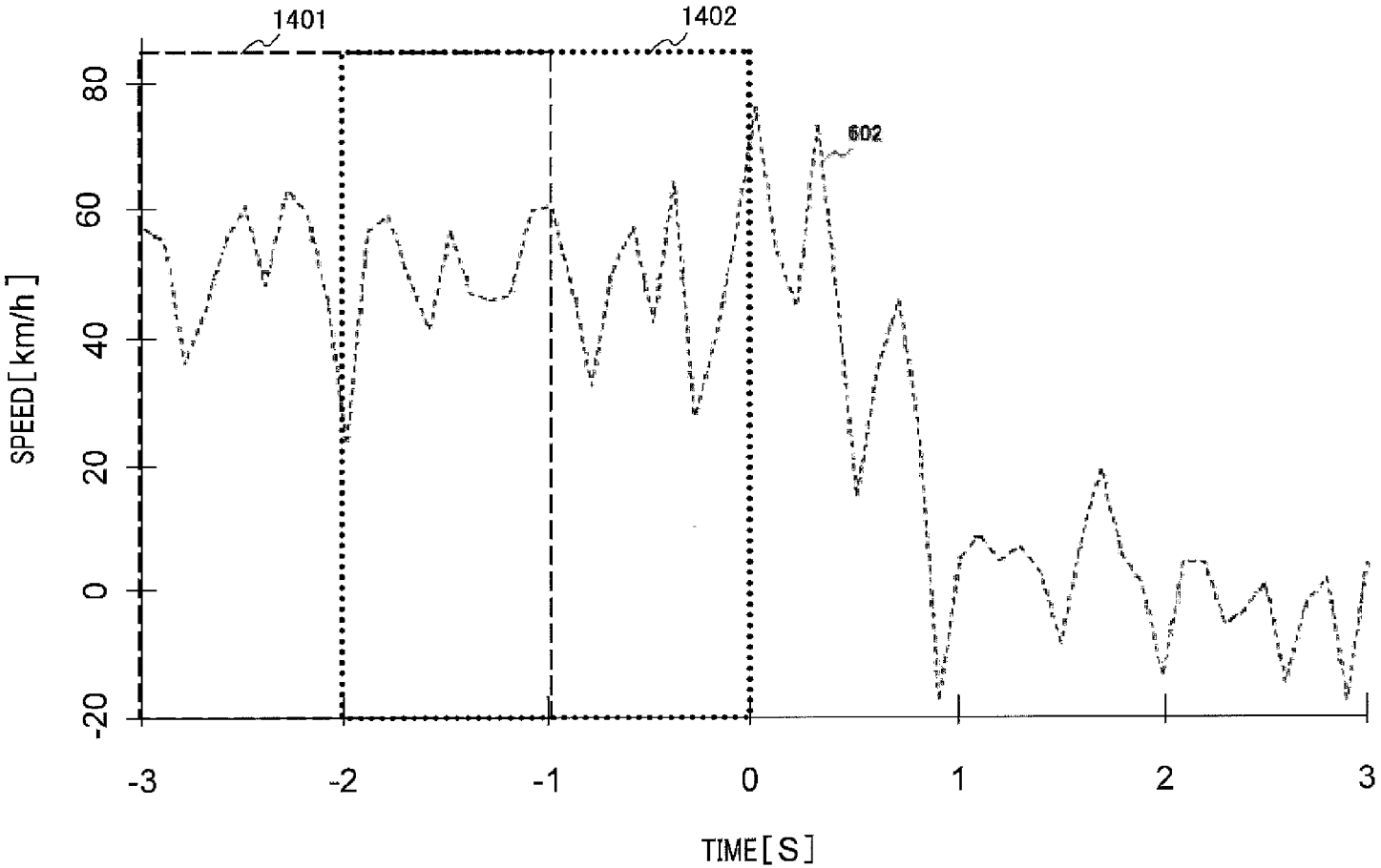
FIG. 11 is a diagram illustrating a search range.

By way of example, in a ease where an observation value is inputted every 100 milliseconds, time-series/reverse-time-series combined estimation section 104 may also be configured to perform processing by shifting a two-second search range by an integer multiple of 100 milliseconds at a time, e.g., by one second at a time. FIG. 11 is a diagram illustrating a search range. Specifically, with respect to FIG. 11, the search start time is successively shifted from −3 seconds to −1 second. First, in order to determine the "time-series speed estimate values" and the "reverse-time-series speed estimate values" during the period between −3 seconds and −1 second based on speed observation values during the period between the search start time of −3 seconds and −1 second, which is 2 seconds therefrom, search range 1401 is set to −3 seconds to −1 seconds. Next, in order to determine the "time-series speed estimate values" and the "reverse-time-series speed estimate values" during the period between −2 seconds and 0 (zero) seconds based on speed observation values during the period between the search start time of −2 seconds and 0 (zero) seconds, which is 2 seconds therefrom, search range 1402 is set to −2 seconds to 0 (zero) seconds. In this case, computations for the "time-series speed estimate values" and the "reverse-time-series speed estimate values" during the period from −2 seconds to −1 second are duplicated. Both are held as data, and subsequent processes are carried out. This is because, by computing "speed estimate values" based on the thus duplicated "time-series speed estimate values" and "reverse-time-series speed estimate values," it is possible to detect complex collision events in a pile-up. Search ranges are subsequently set in a similar fashion.

Figure 12:
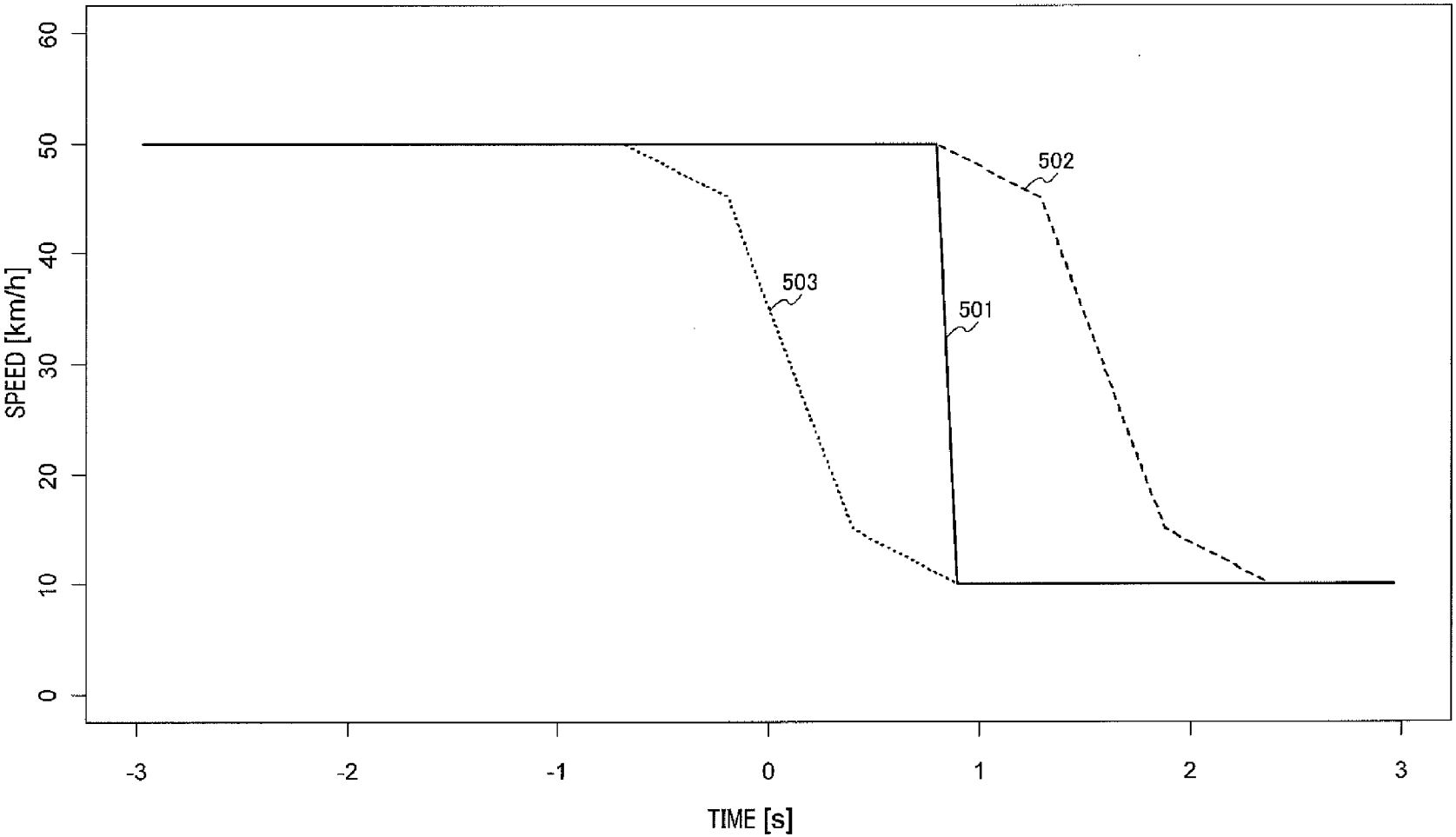
FIG. 12 is a diagram illustrating a switch between first estimate values and second estimate values.

In this case, a property of Kalman filter 303, which is suited for linear estimation, is utilized, namely that it is incapable of following sudden changes in speed corresponding to sudden braking observed in accidents and hiyari-hattos. Specifically, since the quantity that cannot be followed by time-series estimation and the quantity that cannot be followed by reverse-time-series estimation expand in opposite directions, the time at which the distance between the time-series speed estimate values (the first estimate values) and the reverse-time-series speed estimate values (the second estimate values) becomes greatest is taken to be the switch time. This is depicted in FIG. 12. 501 represents true values of speed for a given vehicle. 502 represents the first estimate values for the speed of the given vehicle. 503 represents the second estimate values for the speed of the given vehicle. With respect to FIG. 12, sudden braking takes place at around 1 second. It can be seen that the first estimate values fail to follow the true values for approximately 1.5 seconds immediately after the sudden braking, and that the second estimate values fail to follow the true values for approximately 1.5 seconds immediately before the sudden braking. To put it conversely, the first estimate values do follow the true values up until immediately before the sudden braking, and the second estimate values do follow the true values immediately after the sudden braking. From the above, it may be inferred that sudden braking takes place at the time at which the distance between the first estimate values and the second estimate values becomes greatest. Thus, by switching estimate values between before and after sudden braking to opt for those that follow the true values, it is possible to detect accurate speed changes of the vehicle.

Figure 13:
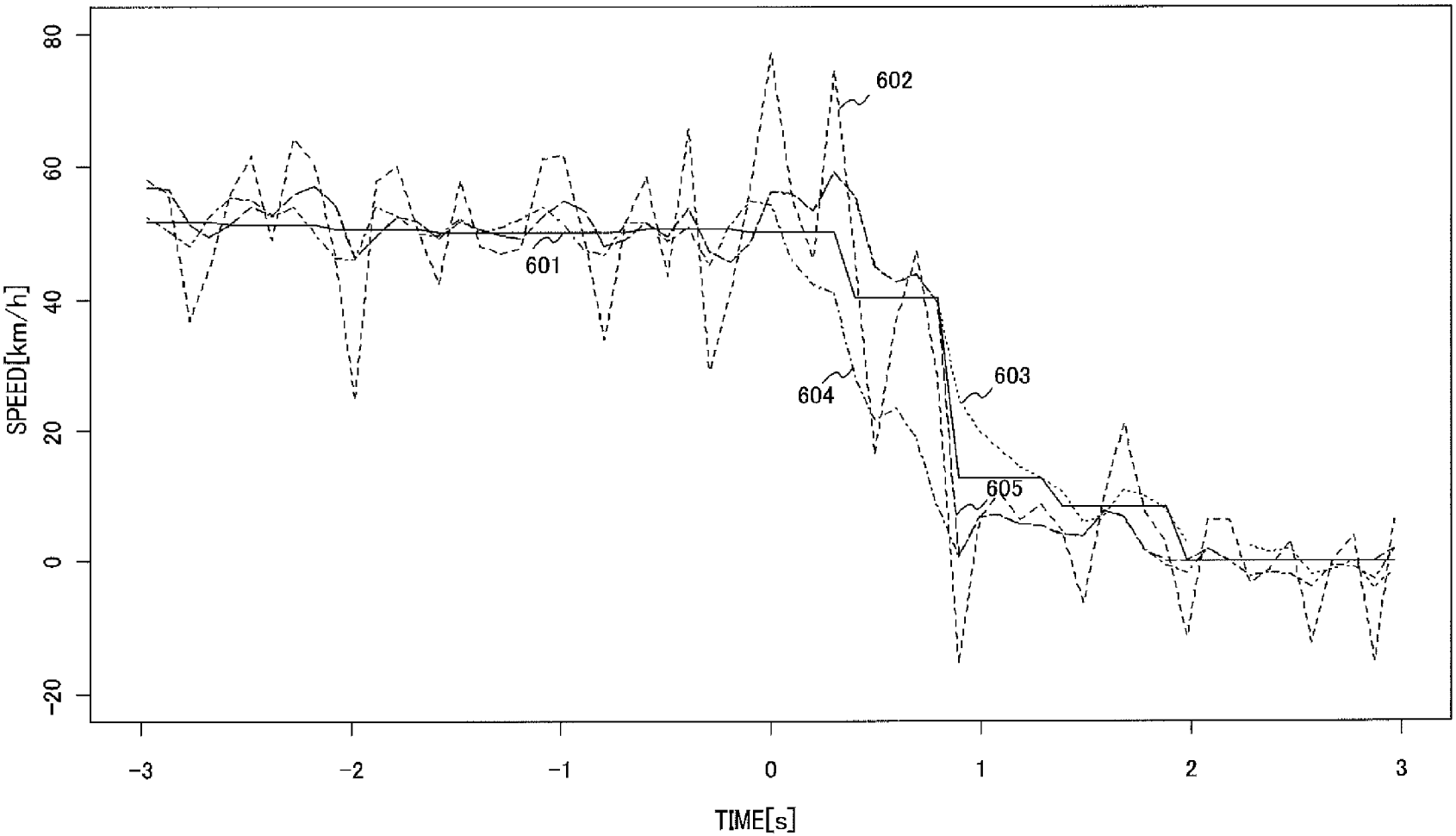
FIG. 13 is a diagram illustrating an operation of the combined estimation section shown in FIG. 7.

FIG. 13 is a diagram illustrating an operation of combined estimation section 206 shown in FIG. 7. With respect to FIG. 13, 601 represents true values of speed for a given vehicle, 602 the observed values of speed for the given vehicle, 603 the first estimate values estimated by time-series estimation section 202 using the observed values of speed for the given vehicle, 604 the second estimate values estimated by reverse-time-series estimation section 204 using the observed values of speed for the given vehicle, and 605 the speed estimate values combined and estimated by combined estimation section 206.

As shown in FIG. 13, first estimate values 603 depart from the true values as estimation fails to follow the sudden change in speed that takes place at 900 milliseconds, and then recover at 1400 milliseconds. Similarly, second estimate values 604 depart from the true values at 900 milliseconds, and retroactively recover at 500 milliseconds. Accordingly, it is possible to infer that 900 milliseconds, at which point the distance between the first estimate values and the second estimate values becomes greatest, is the time at which sudden braking took place. Furthermore, by taking speed estimate values 605, which adopt the first estimate values before the time at which sudden braking took place and the second estimate values after that time, to be combined estimate values, speed estimation that even follows sudden speed changes is made possible.

Figure 14:
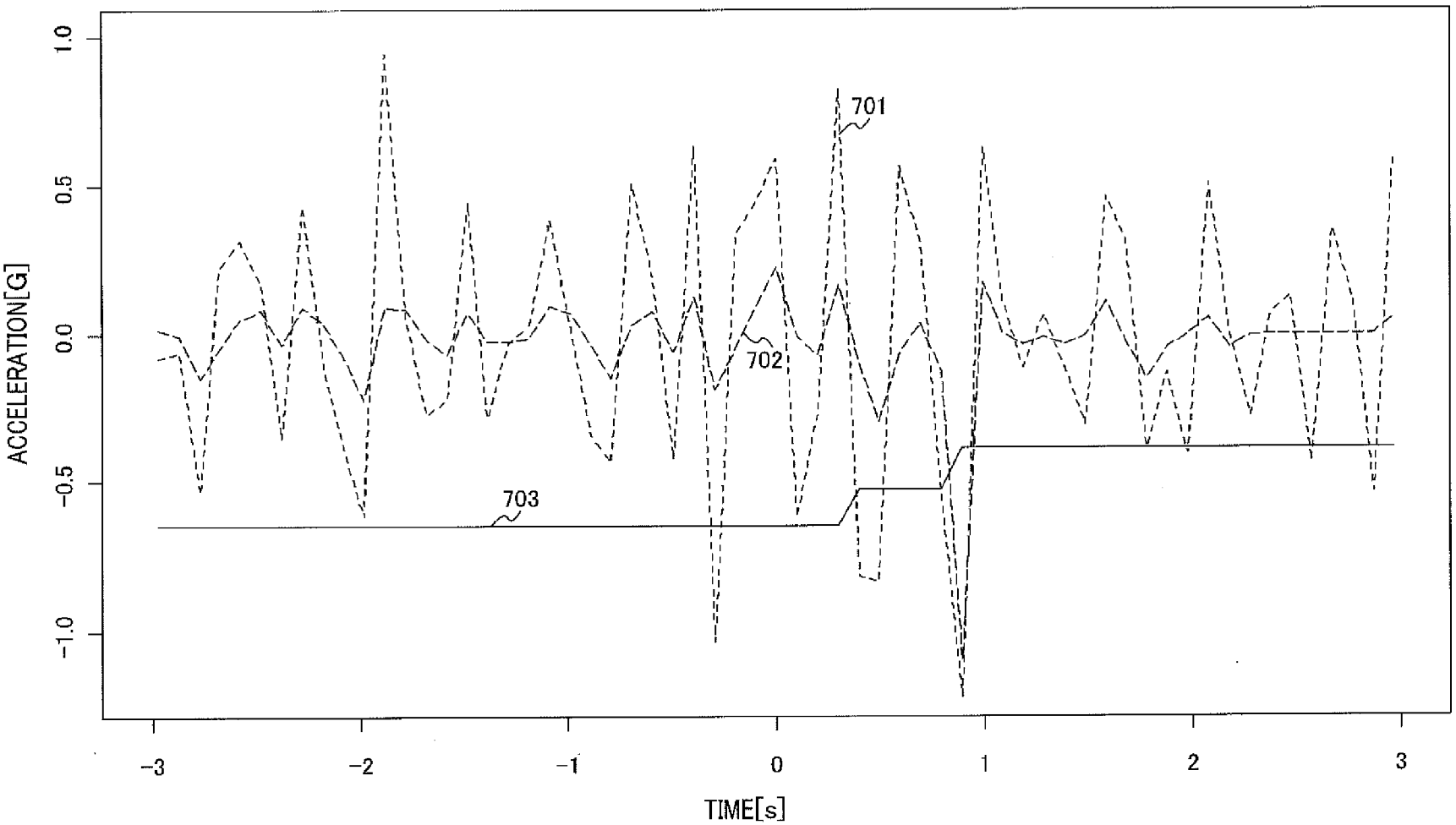
FIG. 14 is a diagram illustrating an operation of the sudden braking determination section shown in FIG. 6.

FIG. 14 is a diagram illustrating an operation of sudden braking determination section 106 shown in FIG. 6. With respect to FIG. 14, there is shown acceleration 701 which is based on speed observation values for a host vehicle, acceleration 702 which is based on combined speed estimate values for the host vehicle, and sudden braking determination threshold 703, which varies with the speed of the host vehicle.

As shown in FIG. 14, acceleration 701, which is based on speed observation values for a given vehicle, exceeds sudden braking determination threshold 703 at several points in time. Thus, the time at which sudden braking took place cannot be determined uniquely based on this alone. Furthermore, since there would be many acceleration values that incorrectly exceed sudden braking determination threshold 703 if significant errors are present in the observation values, a correct value would have to be extracted from among the many incorrect candidates, thereby giving rise to false positives and false negatives. In addition, when detecting hiyari-hattos, which are characterized by minor speed changes, the difference between sudden braking determination threshold 703 and a correct acceleration value becomes smaller. Accordingly, one would have to extract a minor difference that is correct, which gives rise to false positives and false negatives. By contrast, acceleration 702, which is based on combined estimate values of speed for the same vehicle as that of acceleration 701, exceeds sudden braking determination acceleration 703 only at 900 milliseconds, at which point a large speed change takes place. Thus, it is possible to uniquely identify a time at which sudden braking took place, thereby preventing false positives and false negatives.

Thus, with Embodiment 2, the first estimate values are obtained by estimating speed in a time-series fashion based on the speed observation values of the vehicle observed by sensor section 102, and the second estimate values are obtained by estimating speed in a reverse-time-series fashion based on the speed observation values. Up to the time at which the distance between the first estimate values and the second estimate values becomes greatest, the first estimate values, which follow the vehicle speed, are adopted as combined estimate values, and following the time at which the distance becomes greatest, the second estimate values, which follow the vehicle speed, are adopted as the combined estimate values. The above are taken to be the actual speed of the vehicle. It is thus made possible to detect sudden braking. In addition, even if an unpredictable error were to occur in the speed observation values, it would be possible to detect an accurate speed change of the vehicle, that is, the time at which sudden braking took place.

For the present embodiment, with respect to Kalman filter 303, it is preferable that the initial value and system noise parameters be configured to derive a Kalman gain that is suited for linear estimation so as to render Kalman filter 303 incapable of following sudden changes. However, other initial values and system noise parameters may also be used.

With respect to combined estimation section 206, when extracting the time at which the difference between the first estimate values and the second estimate values becomes greatest (i.e., the combination time), it may be so arranged that a comparative determination with respect to the determination threshold is rendered only when that difference is greater than a predetermined threshold, and that a determination of no sudden braking is made when it is less than the predetermined threshold. In this case, the predetermined threshold may also be set dynamically based on the error distribution computed by the Kalman filter, on the S/N obtained by sensor section 102, or on changes in vehicle count, vehicle crowdedness, and/or the like, as observed by sensor section 102.

For the present embodiment, sudden braking determination section 106 may be equipped with a table such as that shown in FIG. 4, for example, and the determination threshold for sudden braking may be set based on this table. This table indicates that the threshold is correspondingly lower in absolute value for lower speeds. There are cases where an acceleration that would not be deemed an accident or a hiyari-hatto for a vehicle traveling on a highway should be deemed an accident or a hiyari-hatto for a vehicle traveling at a low speed. Therefore, making a determination regarding acceleration using a uniform threshold could result in a false positive or a false negative. As such, by lowering the absolute value of the threshold accordingly as the speed becomes lower, it is possible to prevent false positives and false negatives.

For the present embodiment, various radars, such as laser, millimeter wave, and/or the like, may be used as sensor section 102, or a camera involving image processing, or some combination thereof may be used.

For the present embodiment, although changes in the observation values in the forward/rearward direction relative to the travel direction of the vehicle under observation are addressed, they may also be changes in the observation values in the left/right direction as viewed in the travel direction of the vehicle, changes in the observation values in the up/down direction, or some combination of the above. Furthermore, for the present embodiment, speed was used for the observation values. However, the present invention is by no means limited as such, and the distance between sensor section 102 and a vehicle, or the position of a vehicle may also be used. When the distance between sensor section 102 and a vehicle is used, speed may be determined based on the difference between time-series distance values and the time interval between the distance measurements. When the position of a vehicle is used, speed may be determined based on the difference between time-series vehicle positions and the time interval between the position measurements.

For the present embodiment, the Kalman filter is used. However, the present invention is by no means limited as such, and other linear filters may be used, as well as non-linear filters such as the extended Kalman filter, the unscented Kalman filter, etc.

For the present embodiment, in the process of deriving the Kalman gain of the Kalman filter, a speed estimate value from one time unit before or from one time unit after is used. However, it is also possible to use a value from a given number of time units before or after, as well as an integrated value, average value, etc., of up to a given number of time units before or after. Furthermore, the given number of time units may be set dynamically based on the range of variation of the Kalman gain, the range of variation of the estimate values, and/or the like.

For the present embodiment, in order to detect sudden braking as observed in accidents and hiyari-hattos, it is determined whether or not there exists a time at which the distance between time-series speed estimate values and reverse-time-series speed estimate values reaches a global maximum equal to or greater than a specified threshold. However, in order to accommodate cases where several sudden braking events occur, e.g., double collisions, and/or the like, it may also be detected by determining whether or not the distance between time-series speed estimate values and reverse-time-series speed estimate values reaches a local maximum equal to or greater than a specified threshold. When detecting sudden braking based on local maxima, those preceding the smallest local maximum are taken to be first estimate values, and those following the greatest local maximum are taken to be second estimate values. The combined estimate values between the local maxima may be either of the first estimate values and the second estimate values.

The disclosure of the specification, drawings, and abstract included in Japanese Patent Application No. 2010-241982, filed on Oct. 28, 2010, is incorporated herein by reference in its entirety.

INDUSTRIAL APPLICABILITY

A traffic accident detection apparatus and a traffic accident detection method according to the present invention may be applied to the Traffic Accident Automatic Memory System (TAAMS), prevention/safety systems, as well as drive assist systems, and particularly to traffic accident prevention systems, traffic accident cause analysis systems, traffic accident prediction systems, and/or the like, for intersections.

REFERENCE SIGNS LIST

100 Traffic accident detection apparatus
101 Imaging device
102 Sensor section
103 Data analysis section
104 Time-series/reverse-time-series estimation section
105 Acceleration computation section
106 Sudden braking determination section
107 Recording control section
108 Data recording section
201 Observation value buffer
202 Time-series estimation section
203 First estimate value buffer
204 Reverse-time-series estimation section
205 Second estimate value buffer
206 Combined estimation section
301 Estimate value computation section
302 Computation value buffer
303 Kalman filter
800 Traffic accident detection apparatus

The invention claimed is:

1. A traffic accident detection apparatus comprising:

a sensor section that detects a vehicle and obtains speed observation values of the vehicle;

a time-series/reverse-time-series combined estimation section that computes time-series speed estimate values estimated by reading out the speed observation values in a time-series fashion and applying a predetermined filter to the speed observation values read in a time-series fashion, computes reverse-time-series speed estimate values estimated by reading out the speed observation values in a reverse-time-series fashion and applying the predetermined filter to the speed observation values in a reverse-time-series fashion, extracts a time at which the difference between the time-series speed estimate values and the reverse-time-series speed estimate values becomes greatest, and computes speed estimate values by connecting the time-series speed estimate values preceding the extracted time and the reverse-time-series speed estimate values following the extracted time at the extracted time;

an acceleration computation section that computes acceleration values in a time-series fashion based on an amount of change in the speed estimate values per unit time; and a sudden braking determination section that compares the acceleration values and a pre-defined determination threshold in a time-series fashion, and determines a time at which the acceleration values are less than the determination threshold to be a sudden braking time of the vehicle.

2. The traffic accident detection apparatus according to claim 1, wherein the predetermined filter is a filter that takes a predetermined time to follow changes in speed corresponding to sudden braking of the vehicle.

3. The traffic accident detection apparatus according to claim 1, wherein:

the determination threshold varies according to a corresponding per-hour-speed; and the sudden braking determination section obtains the speed estimate values in a time-series fashion, determines a determination threshold for each observation time based on the obtained speed estimate values, and determines the sudden braking time based on the determination thresholds that have been defined and the acceleration values.

4. The traffic accident detection apparatus according to claim 3, wherein the determination thresholds decrease in absolute value in accordance with how slow the corresponding per-hour-speed is, and increase in absolute value in accordance with how fast the corresponding per-hour-speed is.

5. The traffic accident detection apparatus according to claim 1, wherein the predetermined filter is a Kalman filter.

6. The traffic accident detection apparatus according to claim 1, wherein:

the sudden braking determination section performs a comparative determination with respect to the determination threshold only when the acceleration values are greater than a predetermined threshold; and the predetermined threshold is determined by at least one of an error distribution computed by a Kalman filter, a SN ratio obtained by the sensor section, and a vehicle count observed by the sensor section.

7. The traffic accident detection apparatus according to claim 1, wherein a range for the speed observation values used to compute the time-series speed estimate values or the reverse-time-series speed estimate values at the time-series/reverse-time-series combined estimation section is broader than a range for the time-series speed estimate values or reverse-time-series speed estimate values as computation results.

8. The traffic accident detection apparatus according to claim 1, wherein, one time-series speed estimate value at a first time is estimated using at least one speed observation value at a second time preceding the first time, and one reverse-time-series speed estimate value at the first time is estimated using at least one speed observation value at a third time following the first time.

9. A traffic accident detection method, comprising the steps of:

detecting a vehicle and obtaining speed observation values of the vehicle;

computing time-series speed estimate values estimated by reading out the speed observation values in a time-series fashion and applying a predetermined filter to the speed observation values read in a time-series fashion, reverse-time-series speed estimate values estimated by reading out the speed observation values in a reverse-time-series fashion and applying the predetermined filter to the speed observation values in a reverse-time-series-fashion;

extracting a time at which the difference between the time-series speed estimate values and the reverse-time-series speed estimate values becomes greatest;

computing speed estimate values by connecting the time-series speed estimate values preceding the extracted time and the reverse-time-series speed estimate values following the extracted time at the extracted time;

computing acceleration values in a time-series fashion based on an amount of change in the speed estimate values per unit time; and comparing the acceleration values and a pre-defined determination threshold in a time-series fashion, and determines a time at which the acceleration values are less than the determination threshold to be a sudden braking time of the vehicle.

* * * * *